US007518437B2

(12) United States Patent
Yamasaki

(10) Patent No.: US 7,518,437 B2
(45) Date of Patent: Apr. 14, 2009

(54) CONSTANT CURRENT CIRCUIT AND CONSTANT CURRENT GENERATING METHOD

(75) Inventor: Hironori Yamasaki, Kasugai (JP)

(73) Assignee: Fujitsu Microelectronics Limited, Tokyo (JP)

( * ) Notice: Subject to any disclaimer, the term of this patent is extended or adjusted under 35 U.S.C. 154(b) by 0 days.

(21) Appl. No.: 11/296,392

(22) Filed: Dec. 8, 2005

(65) Prior Publication Data

US 2006/0220732 A1 Oct. 5, 2006

(30) Foreign Application Priority Data

Mar. 29, 2005 (JP) ..... 2005-095767

(51) Int. Cl.
*G05F 1/575* (2006.01)
*G05F 1/567* (2006.01)

(52) U.S. Cl. ..... 327/543; 327/513; 327/541; 323/313; 323/315

(58) Field of Classification Search ..... None
See application file for complete search history.

(56) References Cited

U.S. PATENT DOCUMENTS 4,636,742 A * 1/1987 Oritani ..... 330/256
5,587,655 A * 12/1996 Oyabe et al. ..... 323/312
5,818,294 A * 10/1998 Ashmore, Jr. ..... 327/543
6,087,820 A * 7/2000 Houghton et al. ..... 323/315
6,275,100 B1 * 8/2001 Park et al. ..... 327/543
6,489,836 B2 * 12/2002 Yeong ..... 327/541
6,563,371 B2 * 5/2003 Buckley et al. ..... 327/539
6,639,451 B2 * 10/2003 Conte et al. ..... 327/538

FOREIGN PATENT DOCUMENTS

JP H7-49537 11/1995

* cited by examiner

*Primary Examiner*—Lincoln Donovan
*Assistant Examiner*—Terry L Englund
(74) *Attorney, Agent, or Firm*—Kratz, Quintos & Hanson, LLP.

(57) ABSTRACT

A constant current circuit and a constant current generating method, wherein when a voltage in substantially no temperature dependence is applied to an element to output a constant current, temperature dependence of the element can be cancelled. A current indicative of first temperature dependence, which is generated by applying a bias voltage in substantially no temperature dependence to a first current setting section, and a current indicative of second temperature dependence, which is generated by applying a bias voltage in substantially no temperature dependence to a second current setting section are added and outputted as a constant current in substantially no temperature dependence. When a bias voltage in substantially no temperature dependence is applied to a current setting section having resistive components to generate currents, even where the resistive components have temperature dependence, the first and second current setting sections having temperature dependence opposite to each other are parallel-connected and bias voltages are applied thereto, after which the generated currents are added together. Consequently, the temperature dependence contained in the individual current setting sections can be cancelled out and hence a constant current in substantially no temperature dependence can be outputted.

4 Claims, 3 Drawing Sheets

DIAGRAM ILLUSTRATING MODIFICATION OF FIRST EMBODIMENT

DIAGRAM SHOWING MODIFICATION OF SECOND EMBODIMENT

CIRCUIT DIAGRAM OF FIRST EMBODIMENT

DIAGRAM SHOWING TEMPERATURE CHARACTERISTIC OF MOS TRANSISTOR

DIAGRAM ILLUSTRATING MODIFICATION OF FIRST EMBODIMENT

CIRCUIT DIAGRAM OF SECOND EMBODIMENT

DIAGRAM SHOWING MODIFICATION OF SECOND EMBODIMENT

CONSTANT CURRENT CIRCUIT ACCORDING TO RELATED ART

CONSTANT CURRENT CIRCUIT AND CONSTANT CURRENT GENERATING METHOD

CROSS-REFERENCE TO RELATED APPLICATIONS

This application is based upon and claims the benefit of priority from the prior Japanese Patent Application No. 2005-095767filed on Mar. 29, 2005, the entire contents of which are incorporated herein by reference.

BACKGROUND OF THE INVENTION

1. Field of the Invention

The present invention relates to the generation of a constant current, and particularly to a constant current circuit having a constant current characteristic in substantially no temperature dependence, and a constant current generating method.

2. Description of Related Art

FIG. 6 shows a constant current circuit according to a related art. Resistive elements R1 and R2 are series-connected between a predetermined voltage V0 and a ground potential. A division point of both resistive elements is connected to one input terminal of an amplifier. The other input terminal of the amplifier is connected to a source terminal of an NMOS transistor N1. The source terminal of the NMOS transistor N1 is connected to the ground potential via a resistive element R3. A gate terminal of the NMOS transistor N1 is connected to an output terminal of the amplifier. A drain terminal of the NMOS transistor N1 corresponds to an output terminal of the constant current circuit.

A predetermined voltage V0 is divided by the resistive elements R1 and R2, and a voltage V1 divided at the division point therebetween is inputted to the amplifier ($V1=V0\times R2/(R1+R2)$). A signal outputted from the amplifier is applied to the gate terminal of the NMOS transistor N1, and a voltage applied to its source terminal is fed back to the other input terminal of the amplifier, whereby the voltages become approximately identical to each other between the input terminals of the amplifier. That is, the voltage V2 at the source terminal of the NMOS transistor N1 is controlled so as to be approximately equal to the divided voltage V1 ($V2=V1$). The voltage V2 is applied to the resistive element R3 so that an output current I is determined ($I=V2/R3$).

Here, the voltage V2 is equivalent to a voltage ($V2=V1=V0\times R2/(R1+R2)$) which is approximately equal to the divided voltage V1 and obtained by dividing the predetermined voltage V0 by the resistive elements R1 and R2. If the predetermined voltage V0 is assumed to be a voltage in substantially no temperature dependence, which is generated by an unillustrated constant voltage generating circuit or the like, then the divided voltage V1 generated based on the ratio between the resistance values of the resistive elements R1 and R2 can be brought to a temperature dependence-cancelled characteristic even though the resistance values of the resistive elements R1 and R2 have temperature dependence respectively. Thus, the output current I obtained by applying the voltage V2 in substantially no temperature dependence to the resistive element R3 can be set as an output current for the constant current circuit.

A constant current generating circuit configured with bipolar transistors included therein has been disclosed in Japanese examined utility model application publication No. H7 (1995)-49537. A technique has been disclosed therein which is provided with resistive elements each having temperature dependence opposite to that of the bipolar transistor and cancels out temperature dependence at an output current. A voltage corresponding to a base-to-emitter voltage of the bipolar transistor having predetermined temperature dependence is applied to the corresponding resistive element whose resistance value has opposite temperature dependence, thereby to cancel out temperature dependence of a current that flows through the resistive element.

SUMMARY OF THE INVENTION

However, the constant current circuit shown in FIG. 6 is accompanied by the problem that although the voltage V2 applied to the resistive element R3 can be set to have substantially no temperature dependence, the output current I has temperature dependence if the resistive element R3 has temperature dependence.

In Japanese examined utility model application publication No. H7 (1995)-49537, a change in the resistance value of the resistive element due to its temperature dependence is cancelled out by temperature dependence of the value of the voltage applied to the resistive element, thereby to cancel out the temperature dependence of the output current. In the constant current circuit shown in FIG. 6 in contrast to this, the output current I will change due to the temperature dependence of the resistive element R3 while the voltage V2 applied to the resistive element R3 is in substantially no temperature dependence. The means of the above publication '537 cannot be applied to the constant current circuit of FIG. 6, which is supplied with the voltage V2 in substantially no temperature dependence.

The present invention has been made in view of the problems of the related art. It is therefore an object of the present invention to provide a constant current circuit capable of canceling temperature dependence of an element when a voltage in substantially no temperature dependence is applied to the element to output a constant current, and a constant current generating method.

To achieve the object above, there is provided a constant current circuit comprising a first current setting section of which temperature dependence of a path current indicates first temperature dependence, and a second current setting section connected in parallel with the first current setting section and indicating second temperature dependence corresponding to temperature dependence opposite to the first temperature dependence, wherein a bias voltage in substantially no temperature dependence is applied and currents generated by the first current setting section and the second current setting section are added together and the result of addition is outputted.

In the constant current circuit of the present invention, a current indicative of first temperature dependence, which is generated by applying a bias voltage in substantially no temperature dependence to a first current setting section, and a current indicative of second temperature dependence, which is generated by applying a bias voltage in substantially no temperature dependence to a second current setting section, are added and outputted as a constant current in substantially no temperature dependence.

A constant current generating method according to the present invention comprises the steps of generating a first current indicative of first temperature dependence; generating a second current indicative of second temperature dependence opposite to the first temperature dependence; and adding the first current and the second current and outputting the result of addition.

In the constant current generating method of the present invention, the first current indicative of the first temperature dependence, and the second current indicative of the second temperature dependence opposite to the first temperature dependence are added together and outputted as a constant current in substantially no temperature dependence.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Specified embodiments of a constant current circuit and a constant current generating method according to the present invention will hereinafter be described in detail with reference to the accompanying drawings based on FIGS. 1 through 5.

First Preferred Embodiment

Figure 1:
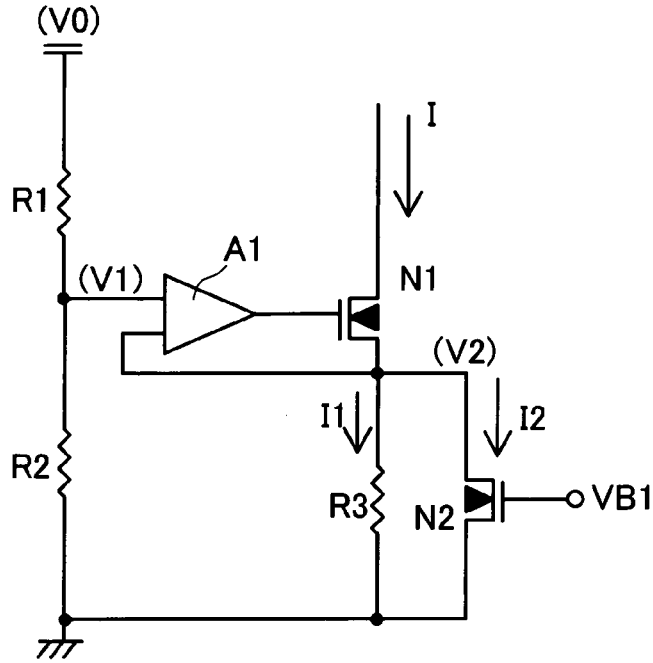
FIG. 1 is a circuit diagram of a first embodiment.

FIG. 1 shows a constant current circuit showing a first embodiment of the present invention. In addition to the constant current circuit shown in FIG. 6, an NMOS transistor N2 is connected in parallel with a resistive element R3. A bias voltage VB1 is applied to a gate terminal of the NMOS transistor N2.

Figure 6:
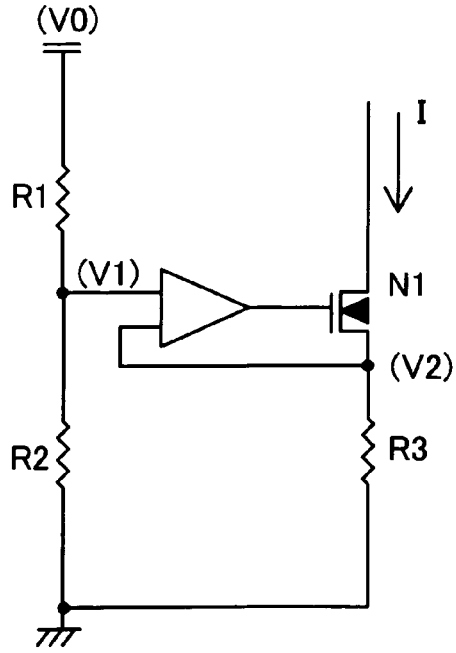
FIG. 6 is a constant current circuit according to a related art.

In a manner similar to FIG. 6, a voltage V2 is fixed to a voltage approximately equal to a voltage V1 by an amplifier A1. A current I1 (=V2/R3) flows through the resistive element R3. Even as to the NMOS transistor N2, a voltage applied to each terminal is fixed, and a predetermined drain current I2 flows therethrough. The resistive element R3 and the NMOS transistor N2 are connected in parallel, and an output current I is outputted via an NMOS transistor N1. Thus, the current I1 and the drain current I2 are added together to obtain the output current I.

Let's now consider where the resistive element R3 is a diffusion resistor formed in a semiconductor manufacturing process. The diffusion resistor generally has a resistance value having positive dependence on temperature. That is, the diffusion resistor has such a characteristic that its resistance value increases with a rise in temperature.

Since the resistance value of the diffusion resistor has the positive temperature dependence where the diffusion resistor is used as the resistive element R3, the current I1 at the application of the voltage V2 corresponding to an approximately constant voltage thereto has negative temperature dependence. A current value decreases with temperature. There is a need to allow the NMOS transistor N2 to have positive temperature dependence as to the drain current I2 in order to cancel out the negative temperature dependence of the current I1.

Figure 2:
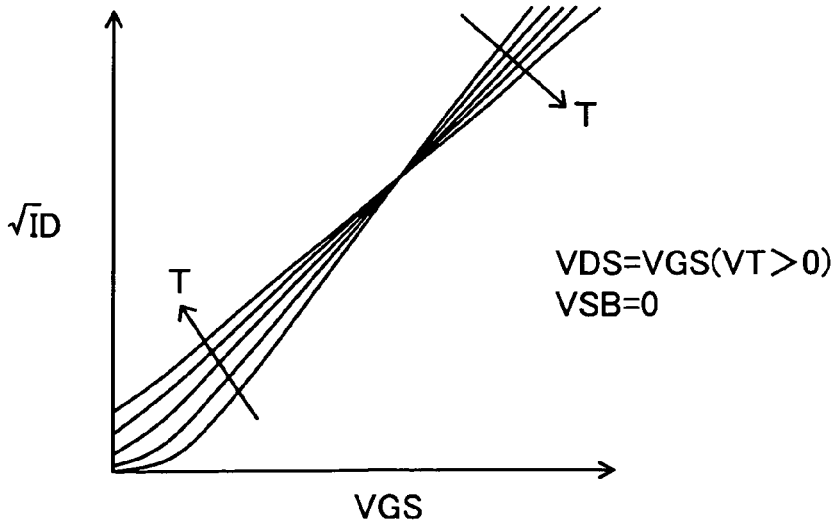
FIG. 2 is a diagram showing a temperature characteristic of a MOS transistor.

A relationship between a gate voltage VGS and a drain current ID with respect to a source terminal of an NMOS transistor is shown in FIG. 2. In FIG. 2, the square root of the drain current ID is represented as the vertical axis. A characteristic diagram of FIG. 2 shows characteristics in a saturation region. As is apparent from the figure, the characteristic of the drain current ID with respect to the gate voltage VGS of the NMOS transistor includes such positive temperature dependence that the drain current ID increases with a temperature T in a low current region with a predetermined current value as a starting point and includes such negative temperature dependence that the drain current ID decreases with the temperature T in a high current region with the predetermined current value as the starting point.

The characteristic shown in FIG. 2, which brings about the temperature dependence, is determined by a drain current equation shown below depending upon manufacturing or/and structural characteristics of a device on the basis of temperature dependence at carrier mobility μ(T) and temperature dependence at a threshold voltage VT(T).

Assuming that a channel length of a MOS transistor is L, a channel width thereof is W, and a capacitance value based on a gate oxide film is Cox, an equation indicative of a drain current in a saturation region of the MOS transistor is given as follows:

$$ID=\tfrac{1}{2}\times W/L\times\mu(T)\times Cox\times(VGS-VT(T))^2 \quad (1)$$

Taking the square root of both sides of the equation (1) and rearranging the equation gives the following equation:

$$\sqrt{ID}=\sqrt{\mu(T)}\times\sqrt{\tfrac{1}{2}\times W/L\times Cox}\times(VGS-VT(T)) \quad (2)$$

FIG. 2 shows the equation (2) illustrated on condition that a drain voltage VDS is the same voltage as the gate voltage VGS (VDS =VGS), and a back gate bias VSB is not applied (VBS=0).

It is now generally known that the mobility μ(T) and the threshold voltage VT(T) have negative dependence on the temperature T. Thus, the following characteristics are brought about from the equation (2).

When the drain current ID is in the low current region, the gate voltage VGS also lies in a low voltage region. Therefore, the temperature dependence of the threshold voltage VT(T) is reflected on that of the drain current ID in the term of (VGS−VT(T)). Since the threshold voltage VT(T) has the negative temperature dependence, the term of (VGS−VT(T)) has positive temperature dependence. Thus, the drain current ID yields positive temperature dependence in the low current region.

When the drain current ID is in the high current region, the gate voltage VGS also falls in a high voltage region. Therefore, the temperature dependence of the threshold voltage VT(T) is hard to see in the term of (VGS−VT(T)). Hence it is not reflected on the temperature dependence of the drain current ID. In contrast, the temperature dependence of the mobility μ(T) is reflected on the drain current ID. Thus, the drain current ID brings about negative temperature dependence in the high current region.

In the constant current circuit shown in FIG. 1, the drain current I2 and its temperature dependence are determined according to conditions of the output current I, current I1, voltage V2 and temperature dependence at the resistance value of the resistive element R3, etc. In the equation (2), a bias voltage VB1 corresponds to the gate voltage VGS in FIG. 2. Adjusting the channel width W, channel length L and bias voltage VB1 makes it possible to obtain a drain current I2 having a desired current value and temperature dependence. The bias voltage VB1 results in a fixed voltage corresponding to the conditions referred to above. While the bias voltage VB1 is capable of being generated by an unillustrated constant voltage generating circuit, it can be obtained by dividing a predetermined voltage V0 by using resistive elements R1 and R2 series-connected between the predetermined voltage V0 and a ground potential or/and by further connecting resistive elements as needed.

When the resistive element R3 is of a diffusion resistor and its resistance value has positive temperature dependence, the current I1 has negative temperature dependence. In this case, the NMOS transistor N2 results in substantially no temperature dependence of the output current I corresponding to the sum of the current I1 and the drain current I2 by selecting the low current region in which the drain current I2 has positive temperature dependence.

If the output current I is obtained by generating the current I1 indicative of the negative temperature dependence, generating the drain current I2 indicative of the positive temperature dependence and adding these currents together, then the outputted output current I can be set to have substantially no temperature dependence.

Figure 3:
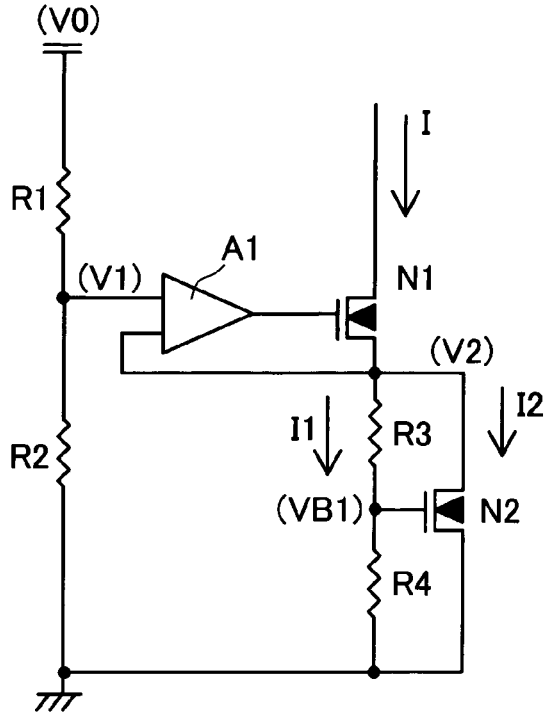
FIG. 3 is a diagram illustrating a modification of the first embodiment.

FIG. 3 is a modification of the first embodiment. The modification is equipped with series-connected resistive elements R3 and R4 in place of the resistive element R3 shown in FIG. 1. A connecting point of the resistive elements R3 and R4 is connected to a gate terminal of an NMOS transistor N2. When a voltage V2 is applied to the resistive elements R3 and R4, a current I1 flows. When the voltage V2 is divided by the resistive elements R3 and R4, a bias voltage VB1 (=V2×R4/(R3+R4)) is outputted from the connecting point.

In this case, the resistive elements R3 and R4 may preferably be constituted of the same material. Thus, since the voltage V2 in substantially no temperature dependence is divided by the ratio between the resistive elements R3 and R4 to generate the bias voltage VB1, the temperature dependence of the bias voltage VB1 has substantially no temperature dependence too.

A drain current I2 and its temperature dependence are determined according to conditions such as the output current I, current I1, voltage V2 and temperature dependence of the resistance values of the resistive elements R3 and R4, etc. Since the bias voltage VB1 is determined according to the voltage V2 and the resistance ratio between the resistive elements R3 and R4, a drain current I2 having a desired current value and temperature dependence can be obtained by adjusting the channel width W and channel length L in accordance with the equation (2).

When each of the resistive elements R3 and R4 is of a diffusion resistor and its resistance value has positive temperature dependence, the NMOS transistor N2 results in substantially no temperature dependence of the output current I corresponding to the sum of the current I1 and the drain current I2 by selecting a low current region in which the drain current I2 has positive temperature dependence.

Since the bias voltage VB1 is obtained by dividing a predetermined voltage using the resistive elements R3 and R4 parallel-connected to the NMOS transistor N2 in the modification of FIG. 3, it is convenient because the bias voltage VB1 can be generated in the vicinity of the NMOS transistor N2 and there is no need to route a long and large wiring for the supply of the bias voltage VB1 to the gate terminal.

Second Preferred Embodiment

Figure 4:
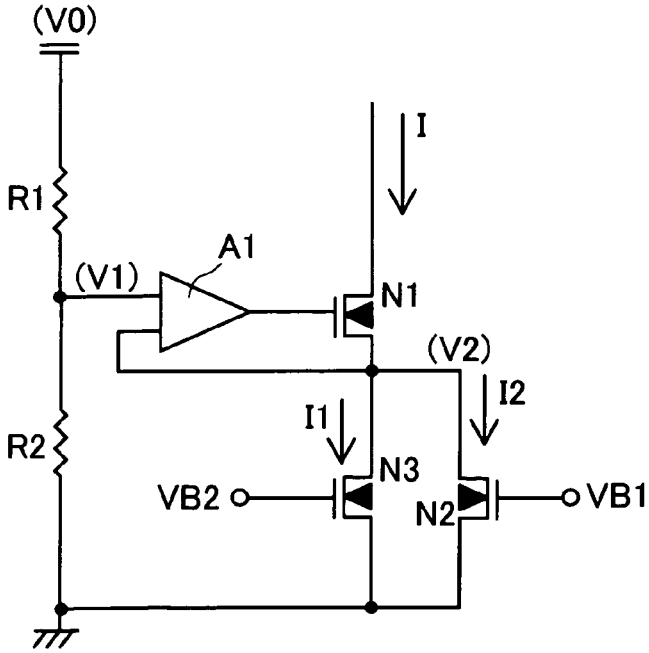
FIG. 4 is a circuit diagram of a second embodiment.

FIG. 4 is a constant current circuit showing a second embodiment. The constant current circuit is provided with an NMOS transistor N3 in place of the resistive element R3 shown in FIG. 1. A bias voltage VB2 is applied to a gate terminal of the NMOS transistor N3.

In a manner similar to the case of the first embodiment (see FIG. 1), a voltage V2 is fixed to a voltage approximately equal to a voltage V1 by an amplifier A1. In each of an NMOS transistor N2 and the NMOS transistor N3, the voltage applied to each terminal is fixed and predetermined drain currents I2 and I1 flow. The NMOS. transistor N2 and the NMOS transistor N3 are connected in parallel, and an output current I is outputted through an NMOS transistor N1. Thus, the drain currents I2 and I1 are added together to obtain the output current I.

If the NMOS transistor N2 and the NMOS transistor N3 are connected in parallel and respectively set to the regions having dependence opposite to each other at the temperature dependence characteristic of the drain current ID shown in FIG. 2, then a characteristic in substantially no temperature dependence can be obtained as the output current I corresponding to the sum of the drain current I2 and the drain current I1.

The drain currents I2 and I1 are respectively allocated to the NMOS transistors N2 and N3 in such a manner that there is substantially no temperature dependence of the output current I according to the output current I and the voltage V2. It is also necessary to adjust the temperature dependence of the drain currents I2 and I1. On the basis of the equation (2), the bias voltages VB1 and VB2 are adjusted and the channel widths W and channel lengths L of the NMOS transistors N2 and N3 are adjusted. While the bias voltages VB1 and VB2 are capable of being generated by an unillustrated constant voltage generating circuit, they can be obtained by dividing a predetermined voltage V0 by using resistive elements R1 and R2 series-connected between the predetermined voltage V0 and a ground potential or/and by further connecting resistive elements as needed.

If elements such as NMOS transistors having temperature dependence opposite to each other with respect to flowing currents are connected in parallel and both currents are added together to obtain the result of addition as an output current I, then temperature dependence can be canceled at the output current I. It is hence possible to obtain an output current I in substantially no temperature dependence.

Figure 5:
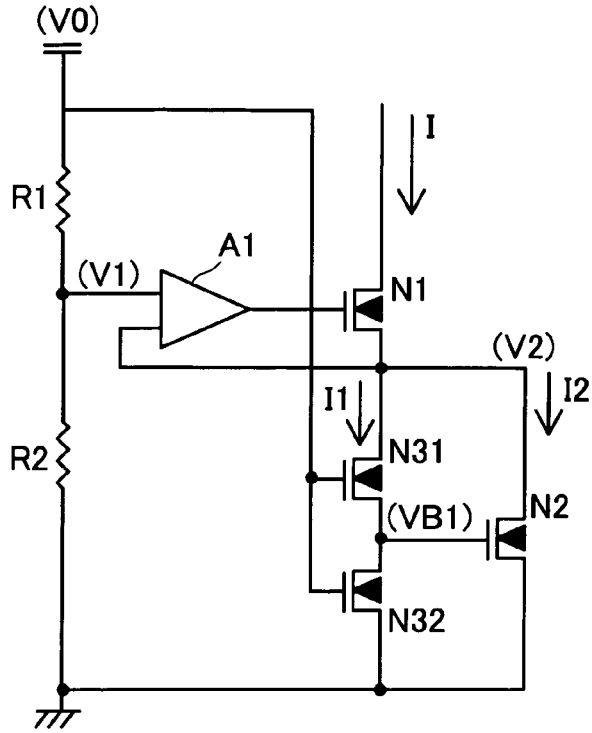
FIG. 5 is a diagram showing a modification of the second embodiment.

FIG. 5 is a modification of the second embodiment. The modification is provided with series-connected NMOS transistors N31 and N32 in place of the NMOS transistor N3 shown in FIG. 4. A connecting point of the NMOS transistors N31 and N32 is connected to a gate terminal of an NMOS transistor N2. Gate terminals of the NMOS transistors N31 and N32 are connected to a predetermined voltage V0. A voltage V2 is applied to a drain terminal of the NMOS transistor N31. Thus, a drain current I1 flows through the NMOS transistors N31 and N32, and the voltage V2 is divided so that a bias voltage VB1 is applied to the gate terminal of the NMOS transistor N2.

The drain currents I2 and I1 are respectively allocated to the NMOS transistors N2, N31 and N32 in such a manner that there is substantially no temperature dependence of an output current I according to the output current I and the voltage V2. It is also necessary to adjust the temperature dependence of the drain currents I2 and I1. Here, the bias voltages applied to the NMOS transistors N31 and N32 are the predetermined voltage V0. The transistor sizes of the NMOS transistors N31 and N32 are adjusted, the bias voltage VB1 applied to the NMOS transistor N2 is adjusted, and the channel widths W and channel lengths L of the NMOS transistors N2, N31 and N32 are adjusted.

In the modification shown in FIG. 5, the bias voltage VB1 is obtained by voltage division using the NMOS transistors N31 and N32 connected in parallel with the NMOS transistor N2. Hence it is convenient because the bias voltage VB1 can be generated in the vicinity of the NMOS transistor N2 and there is no need to route a maximum wiring for the supply of the bias voltage VB1 to the gate terminal.

According to the constant current circuit and the constant current generating method according to the present embodiment, as described above in detail, when a bias voltage in substantially no temperature dependence is applied to a current setting section having resistive components of resistive elements and a MOS transistor or the like to generate currents, even where the resistive components have temperature dependence, first and second current setting sections having temperature dependence opposite to each other are parallel-connected and bias voltages are applied thereto, after which the generated currents are added together. Therefore, the temperature dependence contained in the individual current setting sections can be cancelled out and hence a constant current in substantially no temperature dependence can be outputted.

Here, the resistive element R3 or resistive elements R3 and R4, and the NMOS transistor N2 (see FIGS. 1 and 3) employed in the first embodiment, and the NMOS transistor N3 or NMOS transistors N31 and N32 and the NMOS transistor N2 (see FIGS. 4 and 5) respectively show one examples of the first current setting section and the second current setting section.

Incidentally, the present invention is not limited to the embodiments. It is needless to say that various improvements and changes can be made thereto within the scope not departing from the gist thereof.

Although the present embodiment has explained, for example, the case in which each of the resistive elements R3 and R4 is constituted of a diffusion layer and its resistance value has the positive temperature dependence, the present invention is not limited to it. An NMOS transistor whose drain current I2 has negative temperature dependence can be adjusted even with respect to resistive elements which are constituted of a diffusion layer or a material other than the diffusion layer and whose resistance values have negative temperature dependence, and through which a current I1 having positive temperature dependence flows.

Although the presence of the temperature dependence of the drain current ID has been explained on the basis of the mobility μ(T) and the threshold voltage VT(T) with respect to the characteristics in the saturation region of the NMOS transistor in the equations (1) and (2) and FIG. 2, it is needless to say that similar temperature dependence is brought about even in a non-saturation region. That is, a drain current in the non-saturation region of the NMOS transistor is expressed as shown below with a drain voltage as VDS:

$$ID=W/L\times\mu(T)\times Cox\times\{(VGS-VT(T))-\tfrac{1}{2}\times VDS^2 \quad (3)$$

In the equation (3), mobility μ(T) and a threshold voltage VT(T) contribute to the drain current ID in a manner similar to the equation (2). Contribution of either one of the mobility μ(T) and the threshold voltage VT(T) becomes dominant according to a current region at the drain current ID, so the temperature dependence of the drain current ID changes. It should however be noted that as is apparent from the equation (3), the value of the drain current ID changes according to a drain voltage VDS in addition to a gate voltage VGS in a non-saturation region. As described in the present embodiment, such a configuration that the constant voltage V2 is applied to the drain terminal of the NMOS transistor can also be used in the non-saturation region.

Although the NMOS transistor has been explained by way of example in each of the embodiments, the embodiment may be constituted of PMOS transistors. In this case, an adjustment to temperature-dependence can be made in a manner similar to the case in which the temperature dependence of the drain current is adjusted to the NMOS transistor on the basis of the equation (2) and FIG. 2, except for the case where as the bias voltage for biasing the gate terminal becomes the low voltage, it reaches the high current region. Further, the NMOS transistors and the PMOS transistors can also be configured in mixed form.

According to the present invention, when a bias voltage in substantially no temperature dependence is applied to a current setting section having resistive components to generate currents, even where the resistive components have temperature dependence, first and second current setting sections having temperature dependence opposite to each other are parallel-connected and bias voltages are applied thereto, after which the generated currents are added together. Consequently, the temperature dependence contained in the individual current setting sections can be cancelled out and hence a constant current in substantially no temperature dependence can be outputted.

What is claimed is:

1. A constant current circuit comprising:

a first current setting section of which temperature dependence of a path current indicates first temperature dependence; and a second current setting section connected in parallel with the first current setting section and indicating second temperature dependence corresponding to temperature dependence opposite to the first temperature dependence; and a bias applying section applying bias voltage in substantially no temperature dependence to a connection point of the first current setting section and the second current setting section, wherein currents generated by the first current setting section and the second current setting section are added together and the result of addition is outputted through the bias applying section, either one of the first and second current setting sections includes at least one MOS transistor on a first current path, and other one of the first and second current setting sections is configured so as to have a plurality of resistive elements connected in series on a second current path, and a gate voltage of the at least one MOS transistor provided with either one of the first and second current setting sections is generated by dividing the bias voltage by the resistive elements, wherein the bias applying section comprises:

a transistor having a source terminal connected to the connection point; and an amplifier circuit receiving a reference voltage and the bias voltage at the connection point as input signals, the amplifier circuit adjusting controlling a control terminal of the transistor and adjusting the bias voltage at the connection point to the reference voltage.

2. The constant current circuit according to claim 1, wherein the at least one MOS transistor is configured in such a manner that temperature dependence of a drain current thereof is adjusted according to the gate voltage.

3. The constant current circuit according to claim 2, wherein the first current setting section includes a first MOS transistor, which is one of the plurality of resistive elements, of which a gate voltage is applied in a region indicative of the first temperature dependence, and the second current setting section includes a second MOS transistor, which is the at least one MOS transistor, of which the gate voltage is applied in a region indicative of the second temperature dependence.

4. The constant current circuit according to claim 3, wherein the first current setting section includes a plurality of the first MOS transistors, which form the plurality of the resistive elements, connected in series, and the gate voltage of the second MOS transistor is generated by dividing the bias voltage by the first MOS transistors.

* * * * *